US010327498B2

(12) United States Patent
Burch

(10) Patent No.: US 10,327,498 B2
(45) Date of Patent: Jun. 25, 2019

(54) METHOD OF MAKING KNIT FOOTWEAR HAVING AN INTEGRAL FOOTBED

(71) Applicant: Wolverine Outdoors, Inc., Rockford, MI (US)

(72) Inventor: John H. Burch, Belmont, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 42 days.

(21) Appl. No.: 15/648,514

(22) Filed: Jul. 13, 2017

(65) Prior Publication Data

US 2018/0332920 A1 Nov. 22, 2018

Related U.S. Application Data

(60) Provisional application No. 62/509,070, filed on May 20, 2017.

(51) Int. Cl.
*A43B 1/04* (2006.01)
*A43B 23/02* (2006.01)
(Continued)

(52) U.S. Cl.
CPC ..... *A43B 1/04* (2013.01); *A43B 3/0078* (2013.01); *A43B 9/00* (2013.01); *A43B 13/40* (2013.01);
(Continued)

(58) Field of Classification Search
CPC ..... A43B 1/04; A43B 23/0245; A43B 23/042; A43B 23/02; A43B 23/0225; A43B 23/026; A43B 23/230275
See application file for complete search history.

(56) References Cited

U.S. PATENT DOCUMENTS 4,930,175 A * 6/1990 Chen ..... A43B 7/12 12/142 E
5,351,352 A * 10/1994 Chillemi ..... A43D 21/00 12/145
(Continued)

FOREIGN PATENT DOCUMENTS

CN 202697860 1/2013
CN 202959002 6/2013
(Continued)

*Primary Examiner* — Jila M Mohandesi
(74) *Attorney, Agent, or Firm* — Warner Norcross + Judd LLP

(57) ABSTRACT

A method for making a footwear upper assembly, including knitting a tube to form first and second sock portions integrally joined at an intermediate portion; defining a first sock void and a first opening in the first sock portion; turning the second sock portion inside out, folding relative to the intermediate portion, and moving the second sock portion into the first sock void; inserting a footbed through the first opening into a footbed void formed between first and second lower panels of respective first and second sock portions; and closing the first opening to trap the footbed between the first and second lower panels. Alternatively, the method includes placing the knit tube on a last, placing a footbed adjacent the first lower panel, turning the second sock portion right-side out and moving it around an exterior of the first sock portion, and trapping the footbed within the footbed void.

18 Claims, 9 Drawing Sheets

(51) Int. Cl.

| | |
|---|---|
| ***A43B 23/04*** | (2006.01) |
| ***A43B 3/02*** | (2006.01) |
| ***A43B 13/40*** | (2006.01) |
| ***A43D 3/02*** | (2006.01) |
| ***D04B 9/00*** | (2006.01) |
| ***D04B 1/26*** | (2006.01) |
| ***A43B 3/00*** | (2006.01) |
| ***A43B 9/00*** | (2006.01) |

(52) U.S. Cl.
CPC ..... *A43B 23/026* (2013.01); *A43B 23/0215* (2013.01); *A43B 23/0225* (2013.01); *A43B 23/0275* (2013.01); *A43B 23/042* (2013.01); *A43D 3/02* (2013.01); *D04B 1/26* (2013.01); *D04B 9/00* (2013.01); *D10B 2403/023* (2013.01); *D10B 2501/043* (2013.01)

(56) References Cited

U.S. PATENT DOCUMENTS

| | | | | |
|---|---|---|---|---|
| 5,515,566 | A * | 5/1996 | Ganon | A43B 3/14 12/142 A |
| 6,275,997 | B1 * | 8/2001 | Richardson | A41B 11/005 2/239 |
| 7,793,434 | B2 | 9/2010 | Sokolowski et al. | |
| 8,196,320 | B2 | 6/2012 | Adami et al. | |
| 10,130,144 | B1 * | 11/2018 | Shiao | A43D 8/24 |
| 2006/0010931 | A1 * | 1/2006 | Lynch | A41B 11/005 66/185 |
| 2006/0137223 | A1 * | 6/2006 | Ziccarelli | A43B 1/009 36/55 |
| 2011/0061148 | A1 * | 3/2011 | Egozi | A41B 11/007 2/239 |
| 2013/0313316 | A1 | 11/2013 | Jones | |
| 2014/0150292 | A1 * | 6/2014 | Podhajny | A43B 23/0205 36/50.1 |
| 2015/0128449 | A1 | 5/2015 | Lin et al. | |
| 2015/0342261 | A1 | 12/2015 | Boucher et al. | |
| 2015/0342286 | A1 * | 12/2015 | Huffman | A43B 1/04 36/9 R |

FOREIGN PATENT DOCUMENTS

| | | |
|---|---|---|
| CN | 203369441 | 1/2014 |
| FR | 2999881 | 6/2014 |
| FR | 2999882 | 6/2014 |
| WO | 9003744 | 4/1990 |

* cited by examiner

METHOD OF MAKING KNIT FOOTWEAR HAVING AN INTEGRAL FOOTBED

BACKGROUND OF THE INVENTION

The present invention relates to a method of manufacturing footwear, and more particularly to a method of making an article of footwear incorporating a knit upper that includes an integral footbed.

Most footwear include an upper and a sole secured to a lower surface of the upper. The upper provides a void that receives a wearer's foot and positions the foot with regard to the sole. The sole may provide traction or cushion for the foot under a variety of conditions, e.g., walking, running and/or standing. Uppers typically are formed from conventional materials, such as injection molded polymers, fabric manufactured from spooled yarn or thread, and leather or leather-like materials that are fit and assembled on a last to form a 3D shape for a foot. The upper may include more than one layer of materials to define an exterior layer, an intermediate layer, and an interior layer.

In many cases, the upper may be formed of multiple sections that are joined together to form the completed upper. These sections may be obtained by cutting the material from a larger sheet of material (e.g., a sheet of textile), injection molding techniques, and knitting or weaving a finished textile section. Synthetic or natural materials may be used in creating these sections, which are often joined and formed about a last to produce the upper. In this way, the sections are mechanically manipulated into conforming to the 3D contour of the last.

Footwear manufacturing techniques have evolved through time, however, most are still impaired by associated labor costs and overhead. For example, most conventional footwear are constructed from a variety of components that are precisely fit and overlapped relative to one another, then stitched together by a worker to form the upper of the footwear. The stitching process is very labor intensive and time-consuming. While many footwear manufacturers have outsourced their manufacturing process to countries having significant labor forces, the minimum wage and social tax in those countries has greatly increased the cost of labor in recent years. In turn, this has increased the cost to manufacture footwear.

Accordingly, there remains room for improvement in the area of footwear manufacturing to reduce labor costs and material costs.

SUMMARY OF THE INVENTION

A method is provided for making a footwear upper, as well as a related footwear upper.

In one embodiment, a method of making a footwear upper assembly includes: (a) knitting a tube from a plurality of strands of material so that the tube forms a first sock portion and a second sock portion joined with one another at an intermediate ankle portion, (b) defining in the first sock portion a first sock void configured to receive a human foot and a first opening adjacent a first toe portion of the first sock portion, (c) defining in the second sock portion a second sock void configured to receive a human foot and a second opening adjacent a second toe portion of the second sock portion, (d) turning the second sock portion inside out so that it acquires an inside out configuration, (e) folding the second sock portion relative to the intermediate ankle portion, (f) moving the second sock portion, in the inside out configuration, into the first sock void, (g) forming a footbed void between a first lower panel of the first sock portion and a second lower panel of the second sock portion, (h) inserting a footbed through the first opening into the footbed void, between the first lower panel and the second lower panel, and (i) closing the first opening so that the footbed is trapped between the first lower panel and the second lower panel.

In another embodiment, an upper construction for footwear includes first and second sock portions, a footbed void, and a footbed. The first sock portion includes a first toe portion, a first lower panel, and a first opening adjacent the first toe portion. The first sock portion defines a first sock void. The second sock portion includes a second lower panel and the second sock portion is disposed within the first sock void. The first and second sock portions can be formed by knitting a tube and can be joined together at an intermediate ankle portion or some other portion along the upper, optionally at the respective toe or forefoot sections of the construction. The footbed void is defined between the first and second lower panels, and the footbed is disposed in the footbed void. The footbed is inserted through the first opening of the first sock portion into the footbed void, after which the first opening is closed so that the footbed is trapped between the first lower panel and the second lower panel.

In yet another embodiment, the textile upper can be made using a plurality of strands of material that include at least one fusible monofilament strand knit throughout at least a portion of the upper. A perimeter of the footbed void is heated to fuse the fusible monofilament strands of the first lower panel and the second lower panel such that the perimeter of the footbed void is fused and the footbed is entrapped within the footbed void.

In still another embodiment, a method of making a footwear upper assembly includes: (a) knitting a tube from a plurality of strands of material so that the tube forms a first sock portion and a second sock portion joined with one another at an intermediate portion, the sock portions are knit in an inside-out configuration, (b) defining in the first sock portion a first sock void, (c) defining in the second sock portion a second sock void and a second opening adjacent a second toe portion of the second sock portion, (d) placing the knit tube on a last, optionally so that a first lower portion of the first sock portion is adjacent a portion of the last corresponding to a foot bottom, (e) placing a footbed and/or footbed material adjacent the first lower panel of the first sock portion, and optionally adjacent a portion of the last corresponding to a foot bottom, with the first lower panel between the last and the footbed, (f) optionally closing the first opening of the first sock portion, (g) turning the second sock portion right-side out so that it acquires an aesthetic or right-side out configuration, (h) folding the second sock portion relative to the intermediate portion, (i) moving the second sock portion in the aesthetic or right-side out configuration over and/or around an exterior surface of the first sock portion that faces away from the last, (j) entrapping the footbed between the first lower panel of the first sock portion and a second lower panel of the second sock portion, and (k) closing the second opening of the second sock portion, with the footbed secured between the first lower panel and the second lower panel, within the footbed void between those panels.

In yet another embodiment, the method can include placing a portion of the textile upper into a mold cavity. For example, when the first sock portion is on the last, the last can be placed adjacent a mold cavity with the lower panel adjacent and/or partially in the mold cavity. A plastic, foam material, or other cushioning material, such as ethylene-vinyl acetate (EVA) or polyurethane, can be injected into the mold cavity to injection mold a footbed directly onto the first lower panel of the first sock portion.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
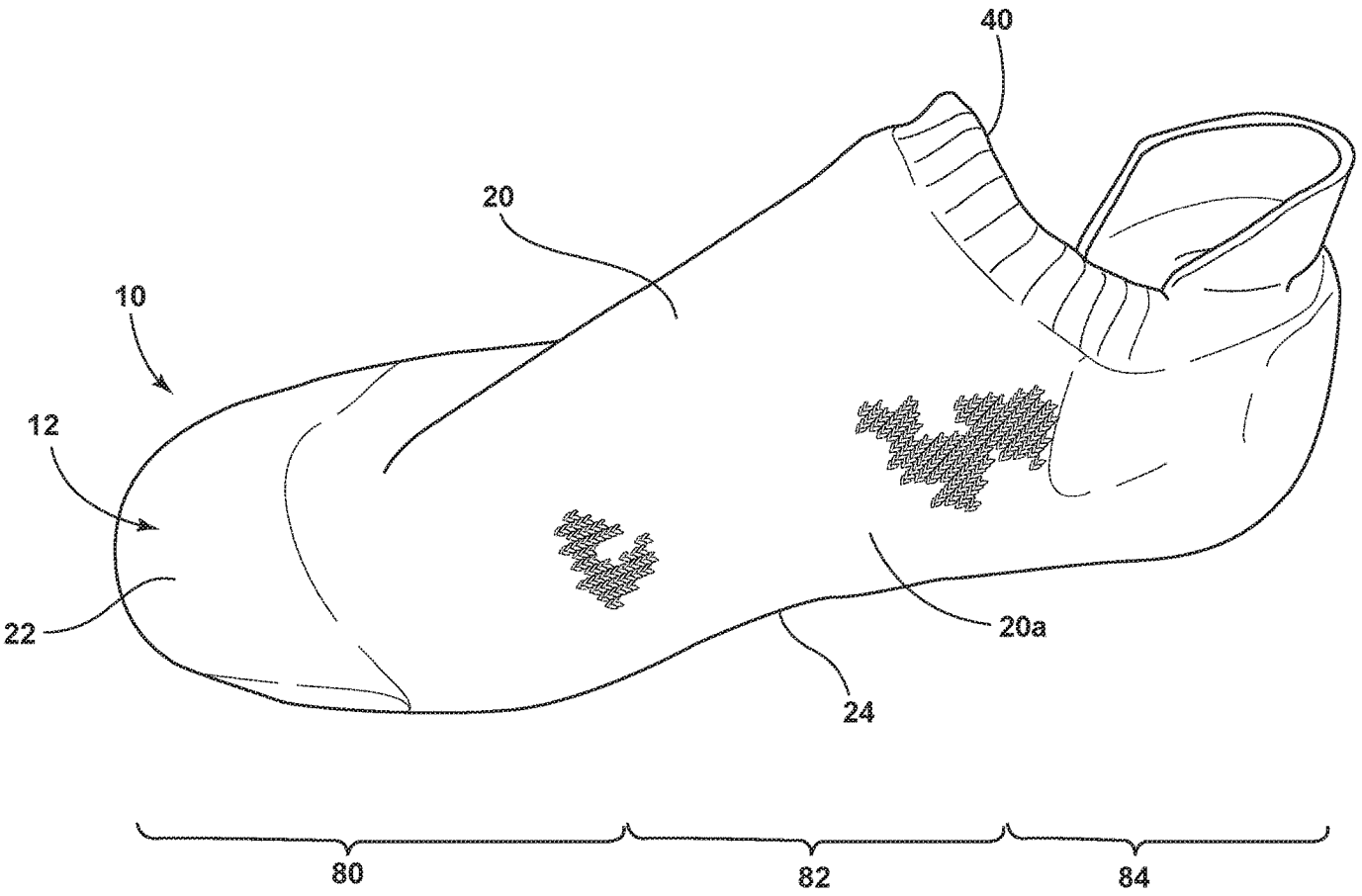
FIG. 1 is perspective view of a completed footwear upper assembly, according to a current embodiment.
Figure 2:
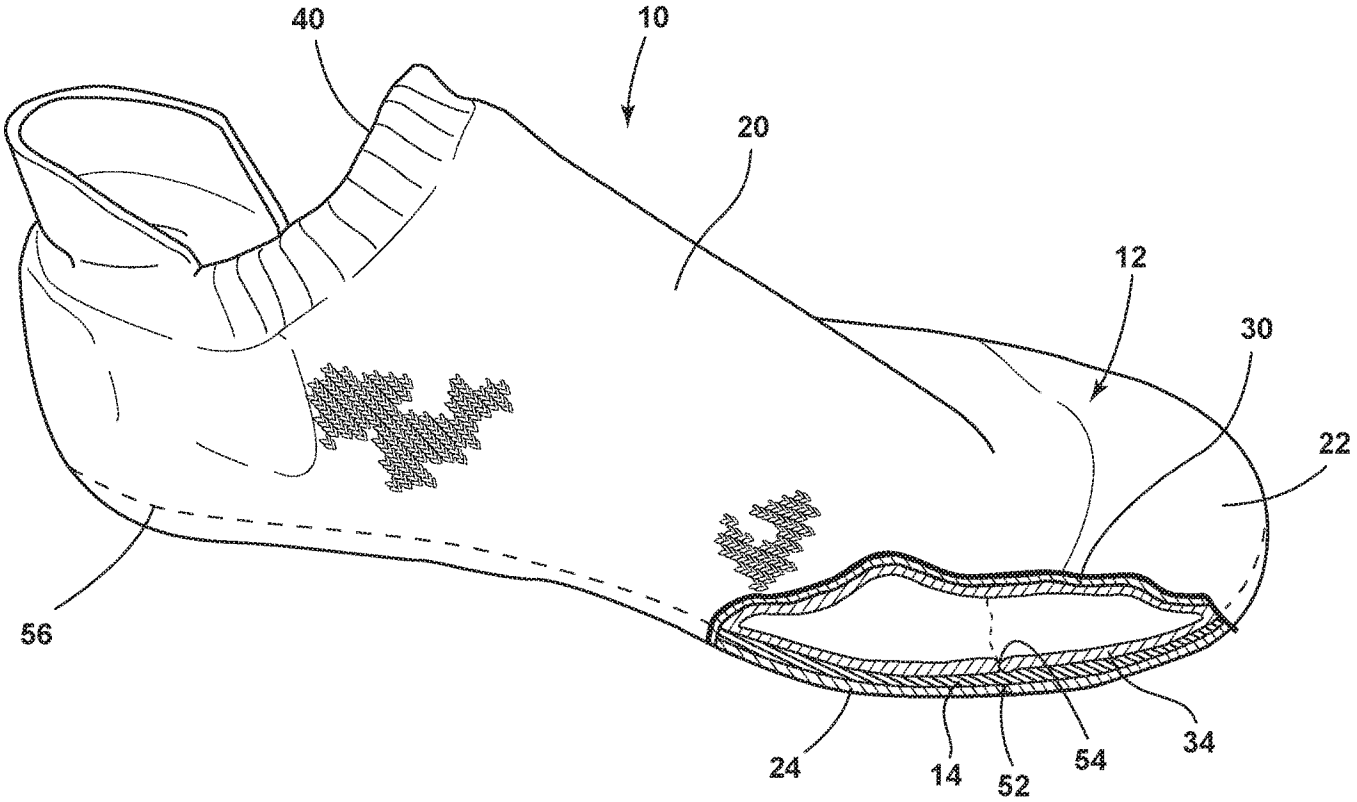
FIG. 2 is a perspective cutaway view of the completed footwear upper assembly, including a cut-away portion of the footwear upper assembly.

A footwear upper assembly, and a method of manufacturing the footwear upper assembly, in accordance with a current embodiment is shown in FIGS. 1-6 and generally designated 10. The completed footwear upper assembly 10 includes a textile upper 12 and an entrapped footbed 14. Although not shown, the footwear upper assembly 10 may be joined with a sole assembly, typically having a midsole and outsole. Further, the footwear can include other conventional upper components disposed in the interior and/or exterior of the upper.

Although the current embodiments are illustrated without the remaining portions of footwear, the footwear upper assembly may be incorporated into any type or style of footwear, including performance shoes, hiking shoes, trail shoes and boots, hiking boots, all-terrain shoes, barefoot running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Further, as used herein, the term "arch region" (or arch or midfoot) refers generally to the portion of the footwear corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot 80, arch or midfoot 82, and heel 84 regions are generally identified in FIG. 1, however, it is to be understood that delineation of these regions may vary depending upon the configuration of the footwear upper assembly and footwear.

Figure 3:
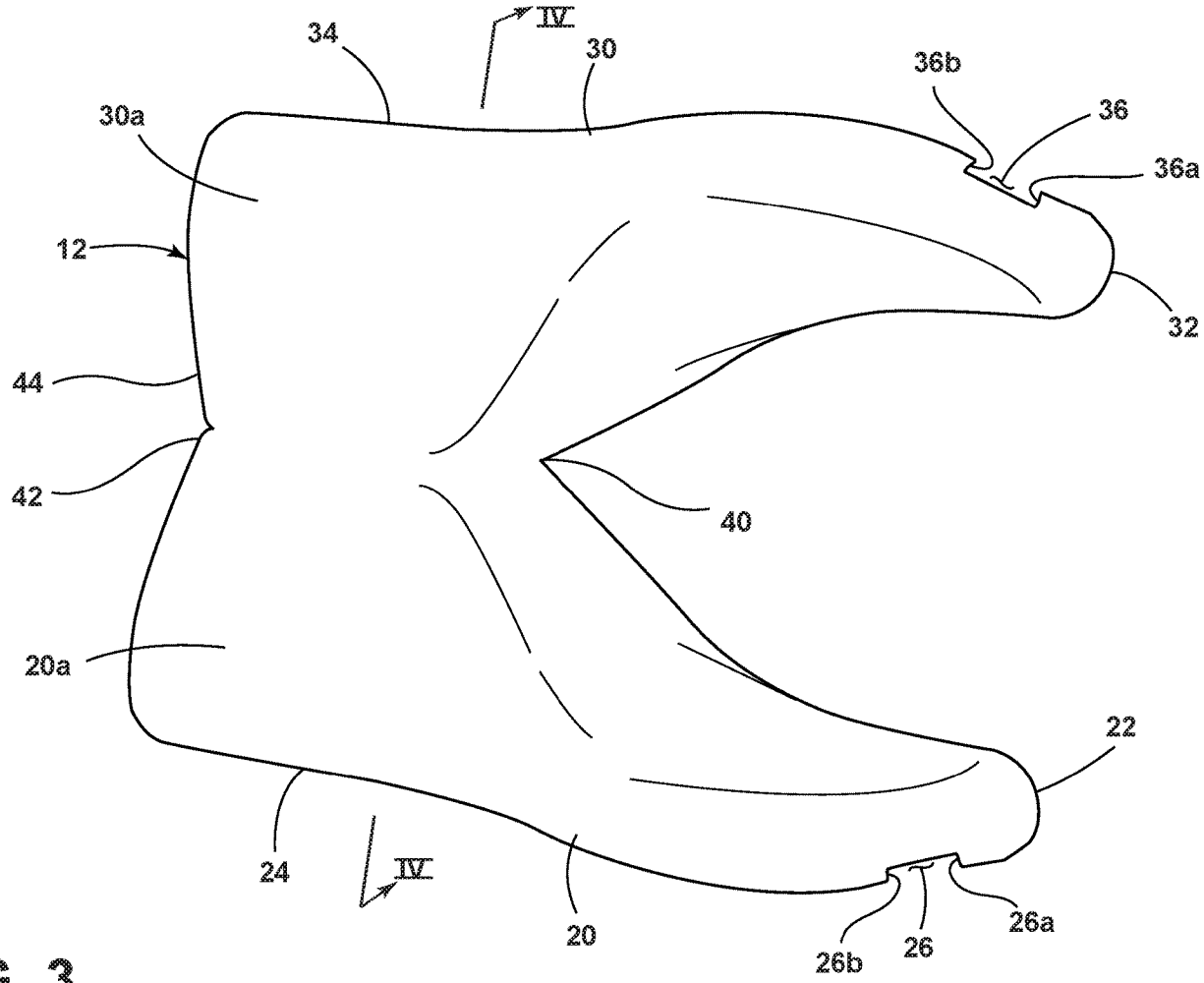
FIG. 3 is a perspective view of a textile upper of the footwear upper assembly, illustrating the textile upper before a turning inside-out step.
Figure 4:
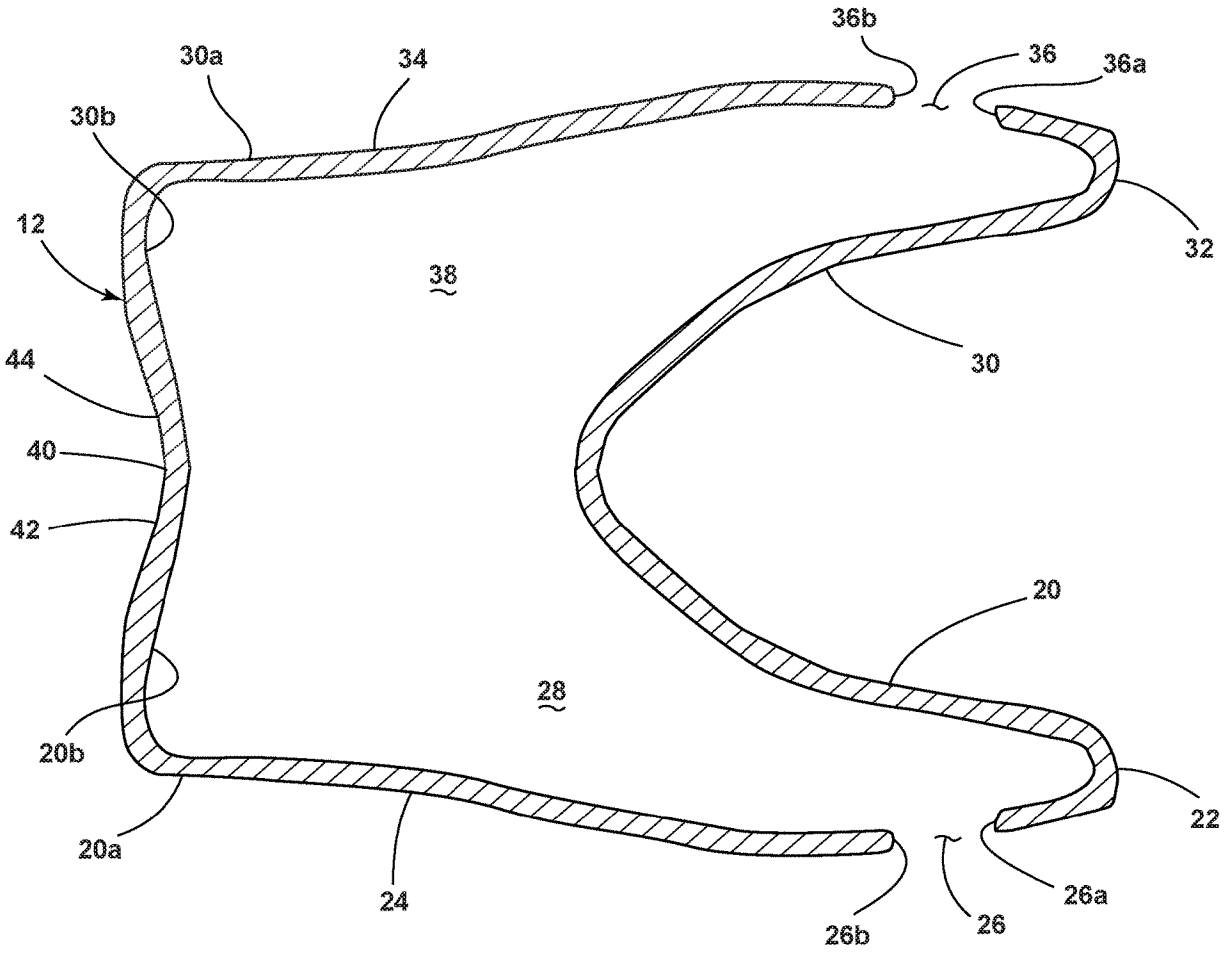
FIG. 4 is a cross sectional view of the textile upper taken along line 4-4 of FIG. 3.

With reference to FIGS. 1-4, the textile upper 12 is formed by knitting, for example circular knitting, a tube from a plurality of strands of material so that the tube forms a first sock portion 20 and a second sock portion 30 joined together at an intermediate ankle portion 40. Of course, other types of knitting can be used to produce the tube, with secondary operations if needed. The tube, as shown in FIGS. 3 and 4, can be two foot-shaped knit members joined together in mirror image relationship. The tube can be nearly fully closed, with the exception of an opening in one, or optionally both, forefoot portions 80 of the tube, as described in greater detail below. Of course, the openings can be placed elsewhere along the tube, in regions corresponding to the toes, phalanges, arch, heel, and/or ankle of a wearer relative to the finished upper.

The first sock portion 20 includes a first toe portion 22, a first lower panel 24, and a first opening 26 adjacent the first toe portion 22. The first sock portion 20 defines a first sock void 28 configured to receive a human foot and the second sock portion 30. Similarly, the second sock portion 30 includes a second toe portion 32, a second lower panel 34, and a second opening 36 adjacent the second toe portion 32. Further, the second sock portion 30 defines a second sock void 38 configured to receive a human foot. The first and second lower panels 24 and 34 can correspond to the lower surface of the textile upper 12, which is underfoot when worn. Optionally, the second opening 36 in the second sock portion 30 may be eliminated.

Figure 5:
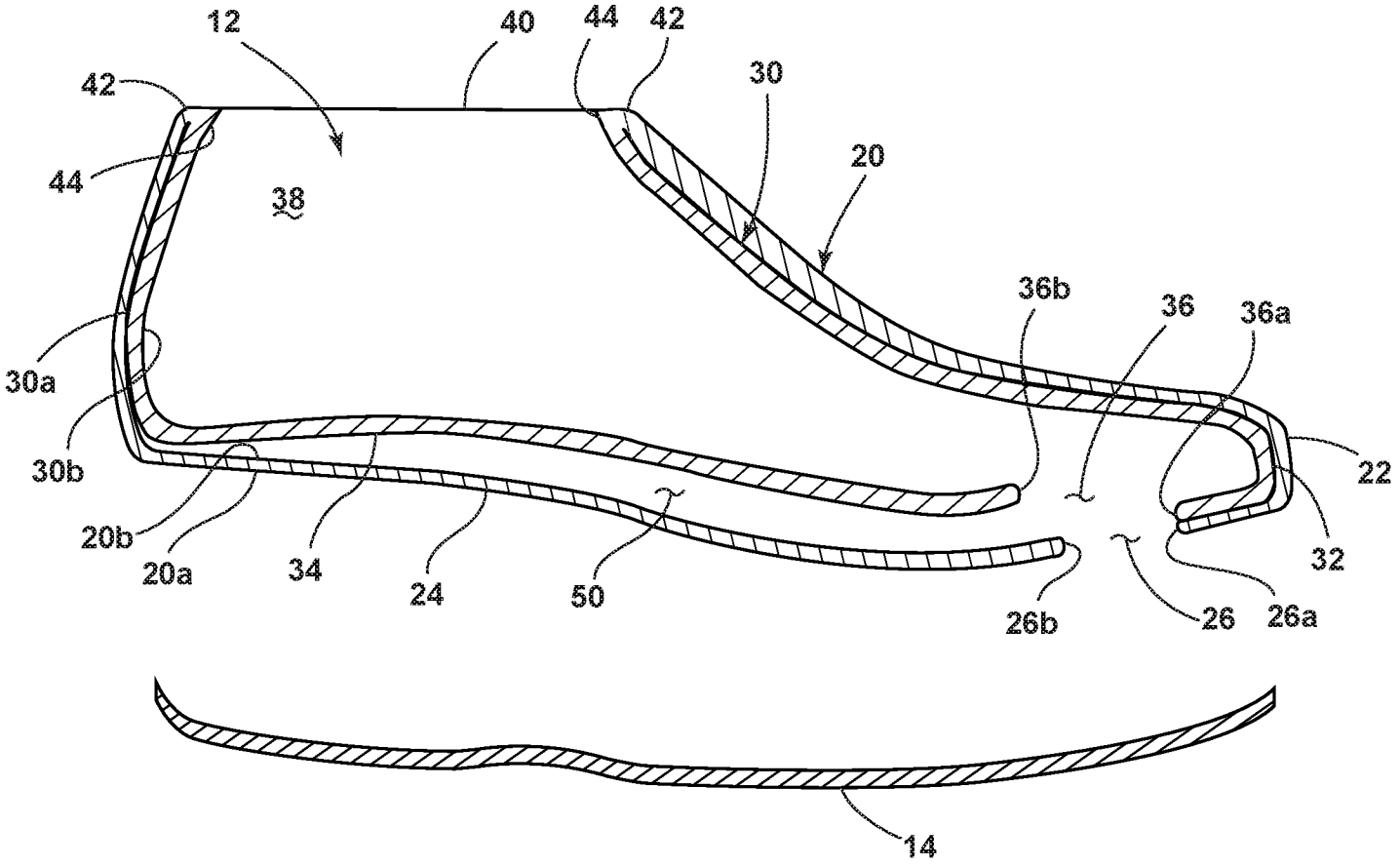
FIG. 5 is a cross sectional view of the textile upper and a footbed, before the footbed is inserted into a footbed void.
Figure 6:
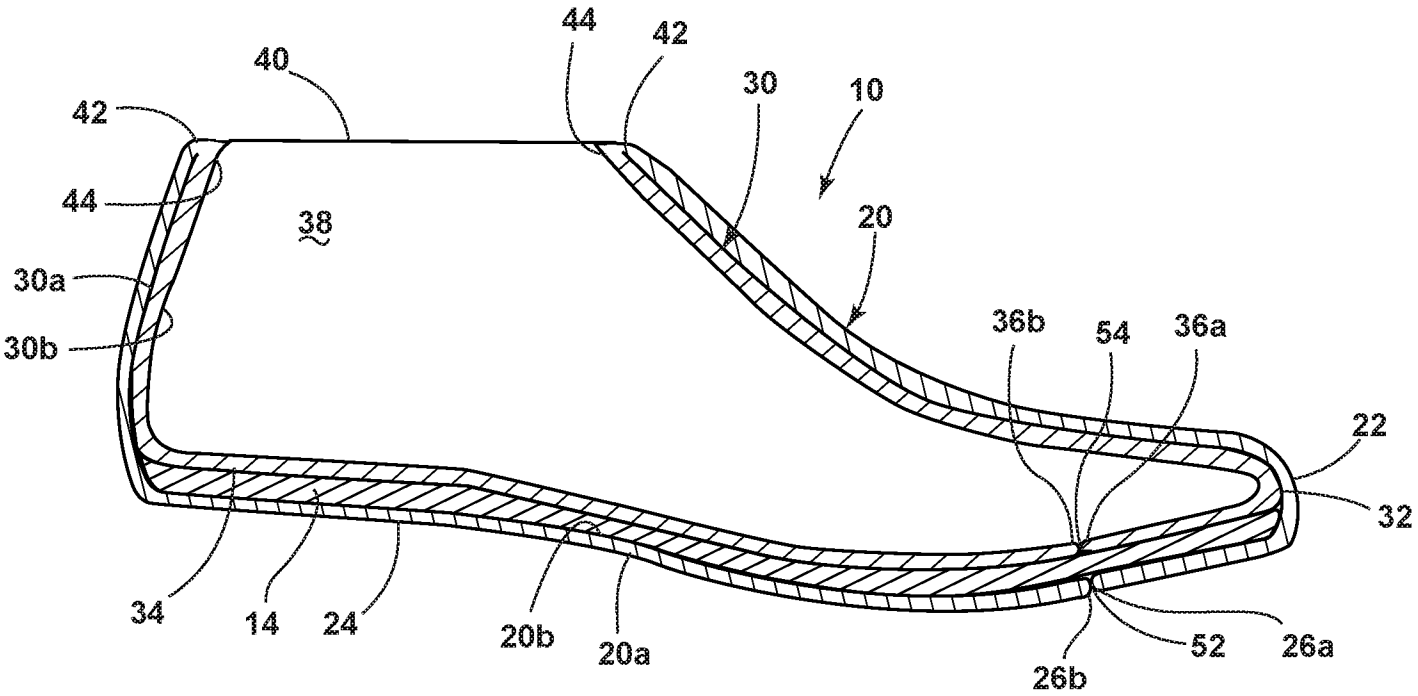
FIG. 6 is a cross sectional view of the completed footwear upper assembly of FIG. 1.

In the unfinished state, illustrated in FIGS. 3-5, the first and second sock portions 20 and 30 can be knitted as an integral textile upper in substantially mirror image arrangement, including identical components, and integrally joined together at the intermediate ankle portion 40. The textile upper 12 defines an aesthetic show surface 12*a* and a non-show surface 12*b*; more specifically, the first and second sock portions 20 and 30 each define a show surface 20*a*, 30*a* and a non-show surface 20*b*, 30*b*. As with knit textiles, one side is the knit side, which is typically the intended show surface, and the other side is the purl side, which is the non-show surface that is generally not visible when worn. Accordingly, the textile upper 12 can be knit with the show surfaces 20*a*, 30*a* on an exterior of the knit tube; the non-show surfaces 20*b*, 30*b* can be on the on the interior of the knit tube. The second sock portion 30, with the show surface 30*a* of the second sock portion 30 on the exterior of the textile upper 12, can be turned inside out so that it is in an inside out configuration, meaning the non-show surface 30*b* of the second sock portion 30 is then on the exterior of the textile upper 12. To accomplish this, the second toe portion 32 of the second sock portion 30 is effectively pushed into the second sock void 38. The inside-out second sock portion 30, led by the second toe portion 32, is then inserted into the first sock void 28. In this configuration, the textile upper 12 is substantially made of two layers: a right-side out first sock portion 20 with the show surface 20*a* defining the exterior of the textile upper 12, and an inside-out second sock portion 30 substantially lining the first sock portion 20, with the non-show surface 30*b* defining the interior of the textile upper 12. Accordingly, the non-show surface 20*b* of the first sock portion 20 and the show-surface 30*a* of the second sock portion 30 engage and/or contact one another and are "inside" the surfaces of the upper assembly 10.

The intermediate ankle portion 40 includes a first collar portion 42 and a second collar portion 44. When the second sock portion 30 is inserted into the first sock void 28 of the first sock portion 20, the first and second collar portions 42 and 44 are effectively folded-over and in juxtaposition. The first and second collar portions 42 and 44 can also be knitted in substantially mirror image arrangement and can be integrally joined for form the intermediate ankle portion 40. Further, the first and second collar portions 42 and 44 can be substantially equidistant from respective first and second lower panels 24 and 34. The intermediate ankle portion 40 can be configured to engage an ankle of wearer, and may be knit with a yarn that includes elastic properties to hold the intermediate ankle portion 40 tight against the wearer's ankle so as to keep the completed footwear upper assembly 10 in place on the wearer's foot. Optionally, the intermediate ankle portion 40 can include certain elastic strands inlaid into surrounding knitted loops to provide elasticity to the ankle portion. The intermediate portion, in general, can be considered to be any portion of the tube between the ends/perimeter of the tube.

With the second sock portion 30 inserted into the first sock portion 20, a footbed void 50 is defined between the first and second sock portions 20 and 30; more specifically, the footbed void 50 is the 3D space bounded by the first and second lower panels 24 and 34 of the first and second sock portions 20 and 30 and extending the length and width of the first and second lower panels 24 and 34.

Referring to FIG. 5, the footbed 14 is positioned within the footbed void 50 and is sandwiched between the first and second lower panels 24 and 34 of the first and second sock portions 20 and 30. More particularly, the footbed 14 defines an upper surface 14*a* and a lower surface 14*b*. The upper surface 14*a* is adjacent the second lower panel 34, and the lower surface 14*b* is adjacent the first lower panel 24. The first and second openings 26 and 36 in respective first and second lower panels 24 and 34 may be closed at respective first and second seams 52 and 54, or by any other suitable joining means. The first and second openings 26 and 36 each define a forward edge 26*a*, 36*a* and a rearward edge 26*b*, 36*b*. The forward edge 26*a*, 36*a* delineates the edge nearest the first and second toe portions 22 and 32; the rearward edge 26*b*, 36*b* delineates the edge nearest the midfoot region 82. The seams 52, 54 can be formed by sewing a strand between opposing edges 26*a* and 26*b* and 36*a* and 36*b*, respectively. Further, the seams 52, 54 can be disposed in the forefoot region 80, for example, under a wearer's toes. Alternatively, the seams 52, 54 can be disposed substantially under the ball of a wearer's foot, near the transition between the forefoot region 80 and the midfoot region 82, or within the midfoot region 82. The seams 52, 54 can be aligned above/below one another, or may be staggered in the fore-aft direction, depending on the application.

The footbed 14 is secured within the footbed void 50 so that the footbed 14 cannot be removed without destroying at least one of the first sock portion 20 and the second sock portion 30. The footbed 14 provides underfoot padding which is concealed within footwear upper assembly 10 and is generally formed of a cushioning foam material, such as ethylene-vinyl acetate (EVA), polyurethane, thermoplastic polyurethane, phylon, or other suitable foams. Accordingly, the footbed 14 can attenuate ground reaction forces and can absorb energy associated with running, walking, or other activities. Although referred to as a footbed, it should be noted that the footbed 14 can be in the form of a conventional footbed, a cushion element, an insole, a midsole or some other sole component. Indeed, reference to a footbed herein can refer to any of the foregoing or other cushioning or support components.

The textile upper 12 is knit from a plurality of strands including at least one fusible monofilament strand knit throughout at least a portion of the textile upper 12. The textile upper 12 is formed by a knitting process, such as circular knitting, flat knitting, raschel knitting or any other knitting processes and the fusible monofilament strand can extend throughout the entire textile upper 12. Although seams 52, 54 may be used to close the first and second openings 26 and 36, a majority of the textile upper 12 can include a substantially seamless configuration. Moreover, the textile upper 12 may be formed of unitary knit construction. As utilized herein, the textile upper 12 is defined as being formed of "unitary knit construction" when formed as a one-piece element through a knitting process. That is, the knitting process substantially forms the various shapes and structures of the textile upper 12 without the need for significant additional manufacturing steps or processes. Although portions and edges of the textile upper 12 may be joined to each other (e.g., seams 52 and 54 closing the first and second openings 26 and 36) following the knitting process, the textile upper 12 remains formed of unitary knit construction because it is formed as a one-piece knit element.

The textile upper 12 optionally forms substantially all of the footwear upper 12; however, a variety of additional elements may be incorporated into the footwear upper assembly 10. For example, the textile upper 12 may also include one or more of: (a) a lace that assists with tightening the upper around the foot, (b) a heel counter in the heel region 84 for enhancing stability, (c) a toe guard in forefoot region 80 that is formed of a wear-resistant material, and (d) logos, trademarks, and placards with care instructions and material information. Optionally, eyelets may be knitted or die cut into the textile upper 12 so that a shoe lace can be threaded therethrough and utilized to tighten the upper around the wearer's foot. Further optionally, a separate component including eyelets can be affixed to the textile upper 12 to receive the laces. The heel counter and/or toe guard can be added as exterior layers formed of leather, synthetic leather, or a rubber material to impart a relatively high degree of wear-resistance and added stability. Optionally, the textile upper 12 can be knitted with two or more different knit patterns. Certain knit patterns can be disposed in certain regions to impart various physical attributes, such as breathability, rigidity, support, elasticity, and/or to mimic a heel counter, toe guard, or other component. Accordingly, the textile upper 12 may incorporate a variety of other features and elements, in addition to the features and elements discussed herein and shown in the figures.

The textile upper 12 can be formed as a knit element produced via a mechanical knitting process performed on an automated knitting machine. Optionally, the knitting machine can be a circular knitting machine, such as a sock or tube knitting machine. Alternatively, the knitting machine can be a flat knitting machine or a jacquard raschel knitting machine. The knitting process can produce the knitted tube, and can incorporate a variety of different knit patterns in the knitted tube and/or the textile upper 12 in general. With regard to knit patterns, the strands forming the textile upper 12 may have one type of knit pattern in one area and another type of knit pattern in another area. Depending upon the types and combinations of knit patterns utilized, areas of the textile upper 12 can have a plain knit structure, a mesh knit structure, a rib knit structure, and various combinations thereof, for example. Different types of knit patterns can be incorporated into specific locations of the textile upper 12 to modify the physical properties or aesthetics of the textile upper 12, such as elasticity, air permeability, stiffness and abrasion-resistance.

Optionally, the textile upper 12 can have one type of yarn formed from multiple strands, optionally twisted together, in one area and another type of yarn in another area. The textile upper 12 also can incorporate yarns with different deniers, materials (e.g., cotton, elastane, polyester, rayon, wool, nylon and mixtures thereof), and degrees of twist. The different types of yarns can affect the physical properties of the textile upper 12, including aesthetics, stretch, thickness, air permeability and abrasion-resistance. By varying and/or combining various types and combinations of knit patterns and yarns, each area of the textile upper 12 may have specific properties that enhance the comfort, durability, and performance of the footwear.

Further optionally, the yarn can include one or more fusible strands knit throughout all or a portion of the textile upper 12. Fusible strands may be heated to fuse to other strands, whether fusible or non-fusible, in selected areas of the textile upper 12 to increase stretch-resistance, stability, support, abrasion-resistance, durability, and/or stiffness, optionally in preselected areas of the footwear. Fusible strands optionally can be in the form of a monofilament strand constructed from a thermoplastic polymer material, such as polyurethane, nylon, polyester and polyolefin. Of course, other types of fusible strands can be used depending on the application. The fusible or thermoplastic polymer material softens or melts when heated and returns to a solid state when cooled to bond adjacent strands of yarn together. Further, the yarn can include varying types and proportions of fusible strands and neutral strands, that is, strands that do not melt.

The textile upper 12 can include fused and unfused areas. The textile upper 12 can be formed to include yarns with fusible strands that are knit throughout substantially the entire textile upper 12. When the yarns with fusible strands are included throughout the textile upper 12 and all areas of the textile upper 12 are heated, the entire upper 12 becomes generally fused. However, where only select areas of the textile upper 12 are heated this can form selected fused areas. Alternatively, the textile upper 12 can be knit to include yarns with fusible strands only through select areas of the textile upper 12. When yarn with fusible strands are located only in select areas of the textile upper 12, the entire textile upper 12 may be heated to form the selected fused areas, the unfused areas remaining. Generally, the first and second sock portions 20 and 30 can be knit with fusible strands, portions can be in contact with one another. Thus, the first and second sock portions 20 and 30 can be optionally fused to one another, forming a base layer and a top layer being fused to one another as a multilayer laminated knitted upper.

Further, a greater proportion of fusible strands may be included in the yarn in select areas of the upper, thereby increasing the durability and stiffness to the selected fused areas. Optionally, the greater the proportion of fusible strands included in the yarn, upon the application of heat or pressure, the greater the degree of durability and stiffness can be imparted to the fused area. For example, the yarn knitted in the first and second lower panels 24 and 34 may incorporate three fusible strands twisted with other non-fusible strands to form a yarn, and the instep region may incorporate one fusible strand twisted other non-fusible strands to form a yarn. Upon heating, the melted or fused area in the lower panels 24 and 34 can provide more strength and shape (precisely mimicking a wearer's foot), while the instep region can be more supple and stretchable so the wearer can don the upper/footwear easily, and so the textile upper 12 feels soft over the wearer's instep.

In one example, a perimeter 54 of the footbed void 50 is heated to fuse fusible strands of the first lower panel 24 and/or the second lower panel 34 such that the perimeter 54 is fused and the footbed 14 is entrapped within the footbed void 50. The fusible strands in the first lower panel 24 can fuse to the fusible and non-fusible strands in the second lower panel 34, and vice versa, to close the footbed void 50. Optionally, sidewalls adjacent the lower panels 24, 34 of the first and second sock portions 20 and 30 and adjacent the footbed 14 contact one another and fuse together when heated. As with the lower panels 24, 34 fusing, fusible strands in the sidewall of the first sock portion 20 can fuse to the fusible and/or non-fusible strands in the sidewall of the second sock portion 30, and vice versa, to close the footbed void 50. In this manner, the footbed 14 is secured in the footbed void 50 so that the footbed 14 cannot be removed without destroying at least the first sock portion 20, the second sock portion 30, and/or the footbed 14 itself.

In another example, the fusible strands of the first lower panel 24 and the second lower panel 34 are heated to fuse the upper and lower surfaces of the footbed 14 to the respective first and second lower panels 24 and 34, thus sealing the footbed 14 within the footbed void 50. Again, the footbed 14 is secured in the footbed void 50 so that the footbed 14 cannot be removed without destroying at least the first sock portion 20 and/or the second sock portion 30.

In yet another example, the first sock portion 20 can include a greater proportion of fusible strands in the yarn, and when fused provides a generally more rigid exterior of the footwear upper assembly 10. In contrast, the second sock portion 30 can include a lesser proportion of fusible strands in the yarn, and when fused provides a generally softer interior of the footwear upper assembly 10 for contact with the wearer's foot.

Figure 7:
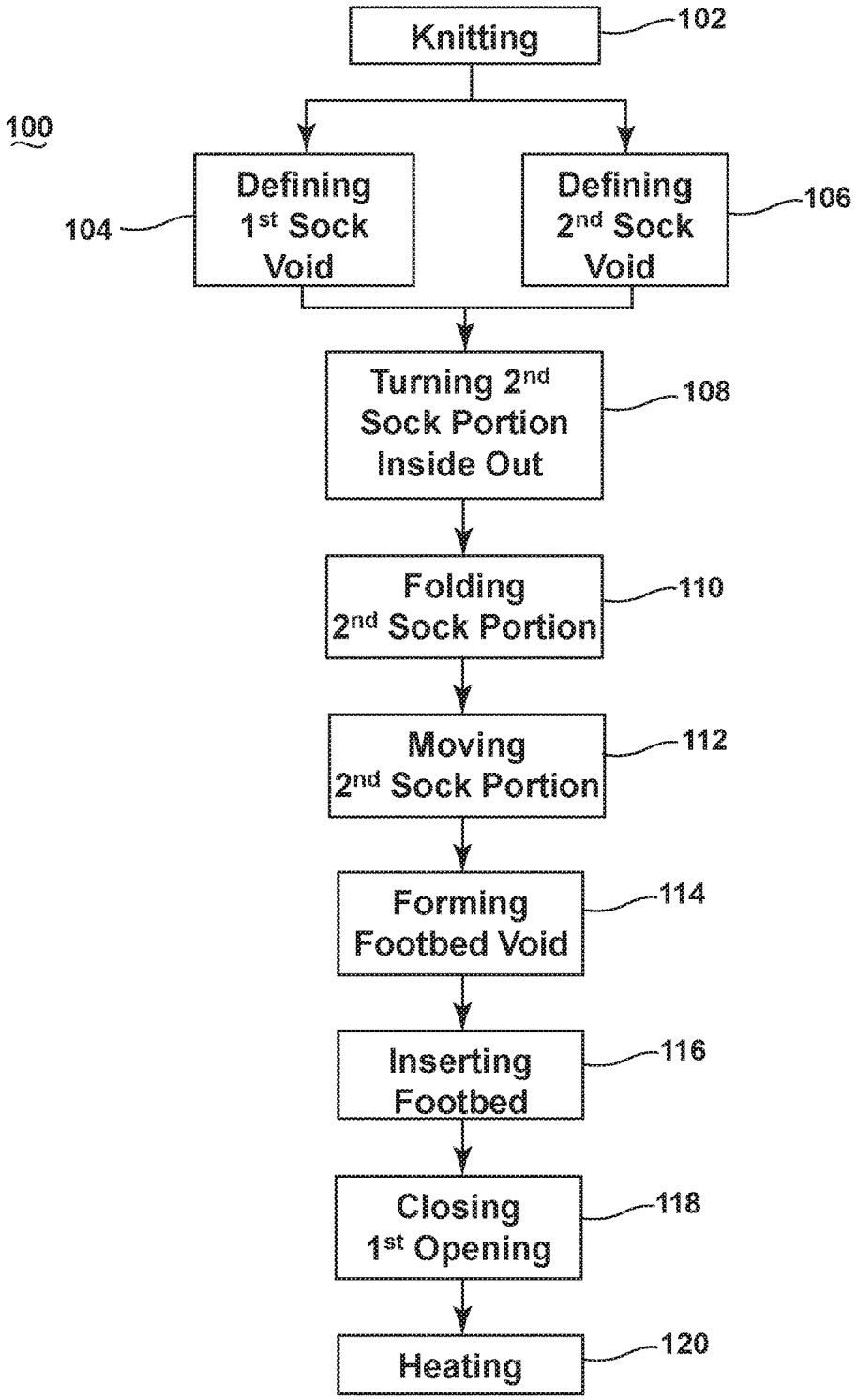
FIG. 7 is a flowchart for a method of making the footwear upper assembly of FIG. 1.

Manufacture of the footwear upper assembly of the current embodiment is presented in the flow chart of FIG. 7. A method 100 of making a footwear upper assembly 10 can include: (a) knitting a tube from a plurality of strands of material so that the tube forms a first sock portion and a second sock portion joined with one another at an intermediate ankle portion, (b) defining in the first sock portion a first sock void configured to receive a human foot and a first opening adjacent a first toe portion of the first sock portion, (c) defining in the second sock portion a second sock void and a second opening adjacent a second toe portion of the second sock portion, (d) turning the second sock portion inside out so that it acquires an inside out configuration, optionally closing the second opening before doing so, (e) folding the second sock portion relative to the intermediate ankle portion, (f) moving the second sock portion in the inside out configuration into the first sock void, optionally so the second sock portion defines a third sock void configured to receive a human foot disposed within the first sock void configured to receive a human foot, (g) forming a footbed void between a first lower panel of the first sock portion and a second lower panel of the second sock portion, (h) providing in the footbed void, between the first lower panel and the second lower panel, optionally inserting the footbed through the first opening, and (i) closing the first opening so that the footbed is trapped between the first lower panel and the second lower panel.

The knitting, depicted as step 102 in FIG. 7, can be any type of conventional knitting, but optionally is performed via a circular knitting process that provides a knitted tube from strands of material so that the tube forms a first sock portion 20 and a second sock portion 30 joined with one another at an intermediate ankle portion 40. As shown in FIG. 3, the first and second sock portions 20 and 30 are knitted in substantially mirror image arrangement. Further, the step of knitting 102 may include knitting fusible strands throughout substantially the entire tube, or optionally only parts of the tube and/or upper, for example, the second sock portion 30 only, and/or select areas of the first and second sock portions 20 and 30. The yarn used for knitting can include at least one fusible monofilament strand with the yarn knit throughout at least a portion of the textile upper 12, and specifically through at least the first and second lower panels 24 and 34.

Defining the first sock void 28 and the first opening 26 adjacent the first toe portion 22 in the first sock portion 20 is depicted as step 104 in FIG. 7. Defining the second sock void 38 configured to receive a human foot and the second opening 36 adjacent the second toe portion 32 in the second sock portion 30 is depicted as step 106. Optionally, the second opening 36 may be eliminated.

Turning the second sock portion 30 inside out so that it acquires an inside out configuration by moving the second toe portion 32 into the second sock void 38 is depicted as step 108. In effect, the show surface 30*a* of the second sock portion becomes the non-show surface 30*b*, and vice versa. Folding the second sock portion 30 relative to the intermediate ankle portion 40 is depicted as step 110. The second collar portion 44 is folded down, inside and adjacent the first collar portion 42 of the first sock portion 20. Moving the second sock portion 30, still in the inside out configuration, into the first sock void 28 is depicted as step 112. After steps 108-112, the inside-out second sock portion 30 is disposed within the first sock void 28, effectively forming two layers of textile upper 12. The show surface 20*a* of the first sock portion 20 defines the exterior surface of the upper assembly 10, and the non-show surface 30*b* of the second sock portion 30 defines the interior surface of the upper assembly 10. As such, the non-show surface 20*b* of the first sock portion 20 and the show-surface 30*a* of the second sock portion 30 engage and/or contact one another and are "inside" the surfaces of the upper assembly 10. Accordingly, mirror image portions of the first and second sock portions 20 and 30 are generally aligned.

Forming a footbed void 50 between the first lower panel 24 of the first sock portion 20 and the second lower panel 34 of the second sock portion 30 is depicted as step 114. Inserting the footbed 14 through the first opening 26 into the footbed void 50 is depicted as step 116. The footbed 14 is therefore positioned between the first lower panel 24 and the second lower panel 24 of the first and second sock portions 20 and 30.

Closing the first opening 26 so that the footbed 14 is trapped between the first lower panel 24 and the second lower panel 34 is depicted as step 118. The first opening 26 of the first sock portion 20 may be closed with a seam 52. Additionally, the second opening 36 of the second sock portion 30 may be also closed with a seam 54. Closing the second opening 36 may occur sequentially with closing the first opening 26, or may be performed before the step 110 of turning the second sock portion 30 inside out.

Optionally, the method 100 may include heating the entire textile upper 12, a portion of the textile upper 12, and/or the perimeter 54 (see FIG. 2) of the footbed void 50 to fuse the fusible strands of the first lower panel 24 and the second lower panel 34, depicted as step 120. In this manner, the lower surface of the textile upper 12 and/or the perimeter 54 of the footbed void 50 is fused and the footbed 14 is therefore entrapped within the footbed void 50. Alternatively, the method 100 may include heating the fusible strands of the first lower panel 24 and the second lower panel 34 such that they are fused to the upper and lower surfaces of the footbed 14. Thus, sealing the footbed 14 within the footbed void 50.

Further optionally, the textile upper 12 can include fused and unfused areas, as described above. If yarns with fusible strands are included throughout the textile upper 12, only select areas of the upper may be heated, forming the selected fused area. If the yarns with fusible strands are included only in select areas of the textile upper 12, the entire textile upper 12 may be heated, forming the selected fused areas and leaving unfused areas. Accordingly, the step 120 of heating may include heating the entire upper or only select areas, as described above. When a greater proportion of fusible strands are included in the yarn in select areas, the select areas undergo more fusing and melting, and the durability and stiffness in the selected areas increases. Optionally, all areas of the textile upper 12 can fuse, but some areas can fuse more than others, producing different effects on stiffness, softness, etc. in different areas.

A first alternate embodiment of a footwear upper assembly 210 is similar to the first embodiment. Therefore, like parts will be identified with like numerals increased by 200, with it being understood that the description of the like parts of the first embodiment applies to the first alternate embodiment, unless otherwise noted.

Figure 8:
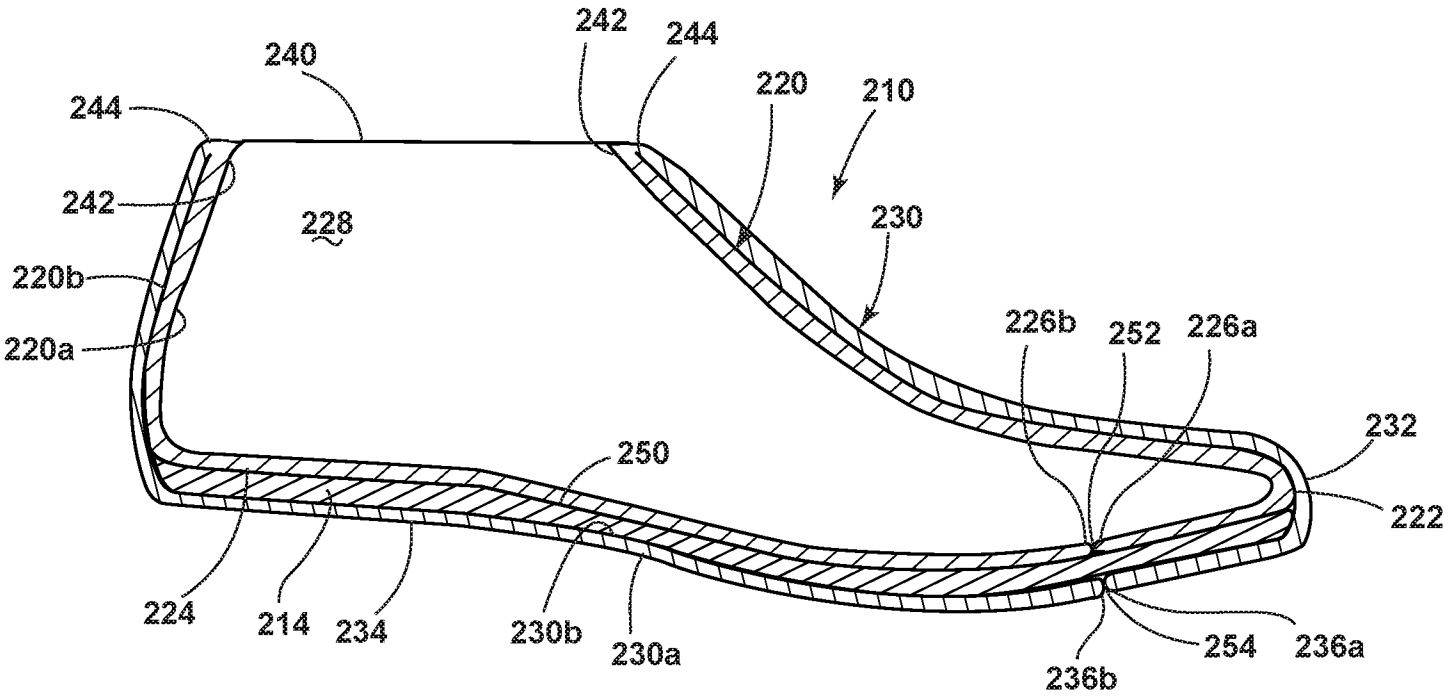
FIG. 8 is a cross-sectional view of a completed footwear upper assembly, according to a first alternate embodiment.

Referring to FIG. 8, the first alternate footwear upper assembly 210 includes a textile upper 212 further optionally formed by knitting a tube from strands so that the tube forms a first sock portion 220 and a second sock portion 230 joined together at an intermediate ankle portion 240. In the unfinished state, the textile upper 212 is knit in an inside-out configuration. That is, the textile upper 212 defines a show surface 212*a* and a non-show surface 212*b*. As with knit textiles, one side is the knit side, which is typically the intended show surface, and the other side is the purl side, which is the non-show surface that is not visible. Accordingly, the textile upper 212 is knit with the surfaces turned inside-out; the non-show surface 212*b* is on the exterior, and the show surface 212*a* is on the interior.

The second sock portion 230 is turned right-side out so that it is in a right-side out configuration, and is then pulled, through a second opening 236 adjacent a second toe portion 232, over the first sock portion 220. In this state, the second sock portion 230 is right-side out, and the first sock portion 220 remains inside-out. In the completed state, the exterior of the finished textile upper 212 is defined by the show surface 212*a* of the second sock portion 230, and the interior of the finished textile upper 212 is defined by the show surface 212*a* of the first sock portion 220.

Similar to the first embodiment, the footbed 214 can positioned within the footbed void 250 and is sandwiched between the first and second lower panels 224 and 234 of the first and second sock portions 220 and 230. The footbed 214 may be tacked, glued, or use any other suitable mechanical means of temporarily or minimally attaching the footbed 214 to the first lower panel 224 to hold it in place before the second sock portion 230 is turned right-side out.

Additionally, the first and second openings 226 and 236 in respective first and second lower panels 224 and 234 may be closed with sewn seams 252 and 254, or by any other suitable joining means. These seams optionally can be sewn closed with a strand, for example a natural yarn. The first and second openings 226 and 236 each define a forward edge 226*a*, 236*a* and a rearward edge 226*b*, 236*b*. The forward edge 226*a*, 236*a* delineates the edge nearest the first and second toe portions 222 and 232; the rearward edge 226*b*, 236*b* delineates the edge nearest the midfoot region 282. The forward edge 226*a*, 236*a* and rearward edge 226*b*, 236*b* are sewn together to close respective first and second openings 226 and 236.

Figure 9:
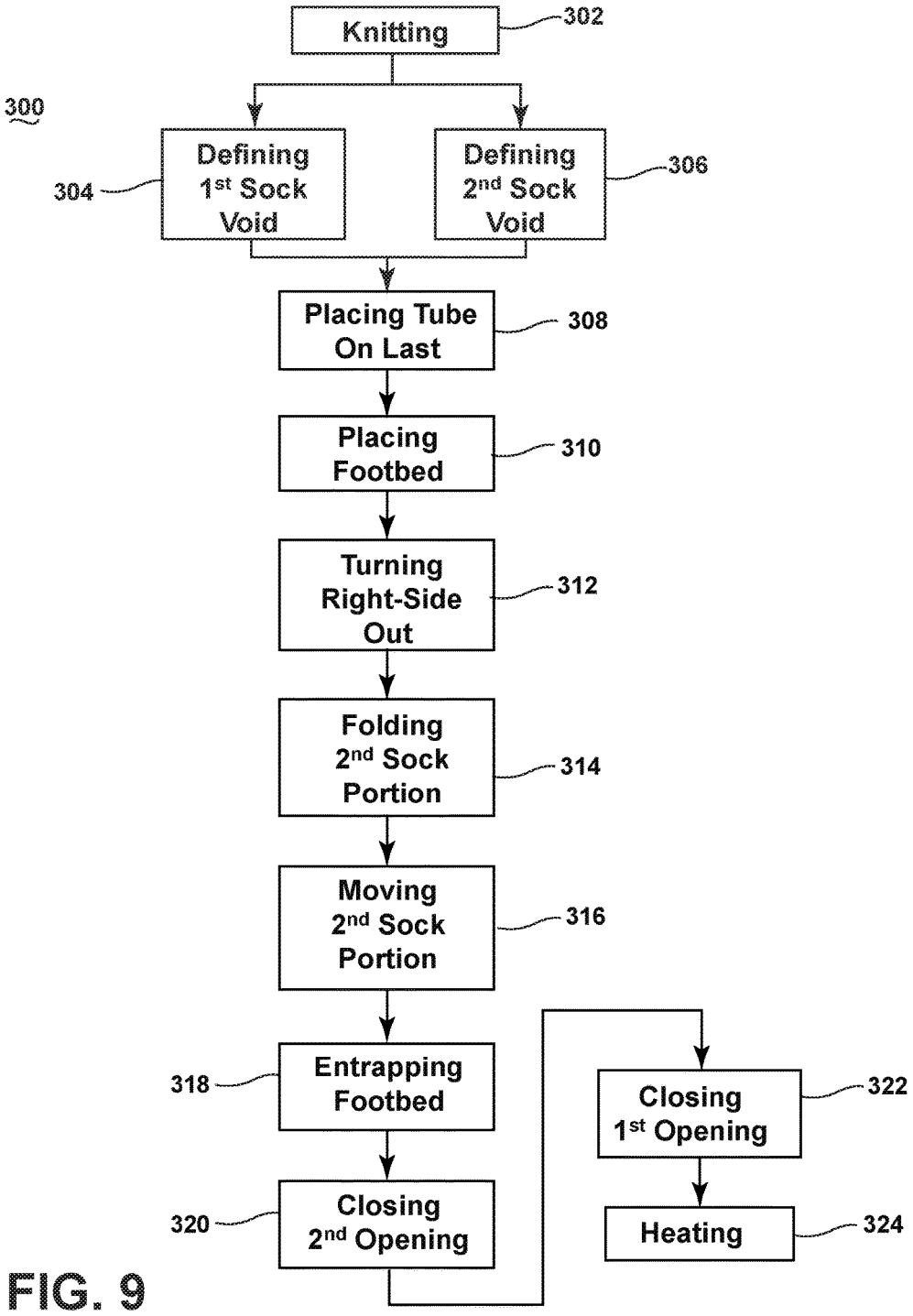
FIG. 9 is a flowchart for a method of making the footwear upper assembly of FIG. 8.

Manufacture of the first alternative embodiment of the footwear upper assembly 210 is presented in the flow chart of FIG. 9. A method 300 of making the footwear upper assembly 210 can include: (a) knitting a tube from a plurality of strands of material so that the tube forms a first sock portion and a second sock portion joined with one another at an intermediate portion, the sock portions are knit in an inside-out configuration, (b) defining in the first sock portion a first sock void, (c) defining in the second sock portion a second sock void and a second opening adjacent a second toe portion of the second sock portion, (d) placing the knit tube on a last, (e) placing a footbed and/or footbed material adjacent a first lower panel of the first sock portion, (f) turning the second sock portion right-side out so that it acquires an aesthetic or right-side out configuration, (g) folding the second sock portion relative to the intermediate portion, (h) moving the second sock portion in the aesthetic or right-side out configuration around an exterior of the first sock portion, (i) entrapping the footbed in a footbed void formed between the first lower panel of the first sock portion and a second lower panel of the second sock portion, and (j) closing the second opening, with the footbed secured between the first lower panel and the second lower panel.

Knitting a tube from a plurality of strands of material so that the tube forms a first sock portion 220 and a second sock portion 230 joined with one another at an intermediate ankle portion 240 is depicted as step 302 in FIG. 9. The first and second sock portions 220 and 230 can be circle knitted in tube form and optionally can be in a substantially mirror image arrangement and knit in an inside-out configuration.

Placing the knit tube, or textile upper 212, on a last (not shown) is depicted as step 308, and placing the upper surface 214*a* of the footbed 214 adjacent a first lower panel 224 of the first sock portion 220 is depicted as step 310. The footbed 214 may be tacked, glued, or use any other suitable mechanical means of temporarily and optionally minimally attaching the footbed 214 to the first lower panel 224 to temporarily hold it in place.

Turning the second sock portion 230 right-side out so that it acquires a right-side out configuration is depicted as step 312. Folding the second sock portion 230 relative to the intermediate ankle portion 240 is depicted as step 314, and moving the second sock portion 230, still in the right-side out configuration, over an exterior of the first sock portion 220 is depicted as step 316. After steps 312-316, the right-side out second sock portion 230 is disposed exterior to the first sock portion 220, effectively forming two layers of textile upper 212. In this configuration, the second sock portion 230 is right-side out, and the first sock portion 220 remains inside-out. Accordingly, the exterior of the finished textile upper 212 is the show surface 230*a* of the second sock portion 230, and the interior of the finished textile upper 212 is the show surface 220*a* of the first sock portion 220.

Entrapping the footbed in a footbed void 250 formed between the first lower panel 224 of the first sock portion 220 and a second lower panel 234 of the second sock portion 230, is depicted as step 318. Closing the second opening 236 so that the footbed 214 is enclosed within the footbed void 250 is depicted as step 320. The second opening 236 of the second sock portion 230 may be closed with a seam 254 so that the footbed 214 is enclosed within the footbed void 250, forming a completed footwear upper assembly 210. The completed footwear upper assembly 210 may then be removed from the last.

Optionally, the tube can be knit with or without a first opening 226 in the first sock portion 226. If the tube includes the first opening 226, the method 300 can include closing the first opening 226, depicted as step 322. Closing the first opening 226 can be performed at substantially any point in the method 300, and optionally before step 308 of placing the tube on the last.

Further optionally, prior to the step of turning the second sock portion 230 right-side out, a portion of the textile upper 212 may be placed into a mold cavity. For example, the last upon which the first sock portion 220 is disposed can be placed adjacent and above a portion of a mold cavity. The lower panel 224 of the first sock portion 220 likewise can be placed adjacent and/or partially in the mold cavity. A plastic or foam material, such as ethylene-vinyl acetate (EVA) or polyurethane, can be injected into the mold cavity to injection mold a footbed 214 onto the first lower panel 224 of the first sock portion 220. Optionally, injection molding the footbed 214 can replace step 310.

Further optionally, the method 300 may include heating the entire textile upper 212, a portion of the textile upper 212, and/or the perimeter 254 of the footbed void 250 to fuse the fusible strands of the first lower panel 224 and the second lower panel 234, depicted as step 324. In this manner, the lower surface of the textile upper 212 and/or the perimeter 254 of the footbed void 250 is fused and the footbed 214 is therefore entrapped within the footbed void 250. In addition, this heating can fuse the fusible strands so that the lower panels acquire a heat set, three-dimensional, self-supporting shapes. Likewise, the remainder of the upper also can be molded and set in a three-dimensional, self-supporting shape that mimics a foot of a wearer. The fusible strands can at least partially melt and bind to adjacent strands. When cured, the strands can hold and set the respective sock portions in a three dimensional form, optionally in the shape of a foot. Alternatively, the method 300 may include heating the fusible strands of the first lower panel 224 and the second lower panel 234 such that they are fused to the upper and lower surfaces of the footbed 214. Thus, sealing the footbed 214 within the footbed void 250.

Utilizing the described methods 100 and 300, a footwear upper assembly can be manufactured with only a few steps and a small number of components. In turn, this can reduce assembly and/or construction time for the footwear, and in particular, the upper, which can lead to significant savings in labor and overall cost of the footwear.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z, in any number of units within those combinations.

The invention claimed is:

1. A method of making a footwear upper comprising:

providing a knitted element from a plurality of strands of material so that the knitted element forms a first sock portion and a second sock portion joined with one another at an intermediate portion with the second sock portion being knit in an inside-out configuration, the second sock portion including a second opening adjacent a second toe portion of the second sock portion;

placing a footbed adjacent a first lower panel of the first sock portion;

folding the second sock portion relative to the intermediate portion so that the second sock portion acquires a right-side out configuration;

moving the second sock portion in the right-side out configuration adjacent the first sock portion; and entrapping the footbed in a footbed void formed between the first lower panel of the first sock portion and a second lower panel of the second sock portion so that the footbed cannot be removed without destroying at least one of the first sock portion and the second sock portion;

whereby the footbed is sandwiched between underfoot knitted layers of the first sock portion and the second sock portion so as to form a completed footwear upper having underfoot padding concealed within the footwear upper.

2. The method of claim 1 comprising heating a lower portion of the footwear upper near the first and second lower panels to fuse at least one fusible yarn such that the lower portion of the footwear upper is fused and the footbed is fused to at least one of the first lower panel and the second lower panel.

3. The method of claim 1 comprising:

closing the second opening by sewing the second opening closed; and closing a first opening by sewing the first opening closed, wherein the first opening is adjacent a first toe portion of the first sock portion.

4. The method of claim 3 wherein the step of placing the footbed adjacent the first lower panel of the first sock portion includes inserting the footbed through the second opening into the footbed void before the step of closing the second opening.

5. The method of claim 1 wherein the step of entrapping includes heating the entire footwear upper to fuse the fusible strands.

6. The method of claim 5 wherein the step of knitting includes circular knitting fusible strands throughout substantially the entire knitted element which is in the form of a tube.

7. The method of claim 6 wherein the step of entrapping includes heating select areas of the footwear upper to fuse the fusible strands to impart durability to the select areas of the footwear upper.

8. The method of claim 1 comprising:

placing the first sock portion and the second sock portion on a last so that the first lower panel is adjacent the last.

9. The method of claim 8 comprising:

moving the footbed in the footbed void while the first lower panel contacts the last, so that the footbed moves the second lower panel away from the first lower panel.

10. The method of claim 8 comprising:

placing the footbed adjacent the first lower panel; and moving the second lower panel over the footbed while the footbed is disposed adjacent the first lower panel, and the first lower panel is adjacent the bottom of the last.

11. A method of making a footwear upper comprising:

knitting a tube from a plurality of strands of material so that the tube forms a first sock portion and a second sock portion joined with one another at an intermediate portion;

defining in the first sock portion a first sock void and a first opening adjacent a first toe portion of the first sock portion;

defining in the second sock portion a second sock void configured to receive a human foot;

turning the second sock portion inside out so that it acquires an inside out configuration;

folding the second sock portion relative to the intermediate portion;

moving the second sock portion in the inside out configuration into the first sock void;

forming a footbed void between a first lower panel of the first sock portion and a second lower panel of the second sock portion;

inserting a footbed through the first opening into the footbed void, between the first lower panel and the second lower panel; and closing the first opening so that the footbed is trapped between the first lower panel and the second lower panel.

12. The method of claim 11 comprising heating a lower portion of the footwear upper near the first and second lower panels to fuse at least one fusible yarn such that the lower portion of the footwear upper is fused and the footbed is fused to at least one of the first lower panel and the second lower panel.

13. The method of claim 12 comprising heating the at least one fusible strand of the second lower panel such that the second lower panel is fused to a surface of the footbed, thereby immovably sealing the footbed within the footbed void.

14. The method of claim 11 wherein the step of closing comprises sewing the first opening closed after the footbed has been inserted.

15. The method of claim 14 comprising closing the second opening by sewing the second opening closed.

16. The method of claim 15 wherein the step of closing the second opening is performed before the step of turning the second sock portion inside out.

17. The method of claim 15 wherein some areas of the upper remain unfused.

18. The method of claim 11 comprising:

placing the first sock portion and the second sock portion on a last so that the first lower panel is adjacent the last.

* * * * *